United States Patent [19]

Faber

[11] Patent Number: 4,859,823

[45] Date of Patent: Aug. 22, 1989

[54] ELECTRIC INDUCTION HEATER

[75] Inventor: Michael R. Faber, Warren, Ohio

[73] Assignee: Ajax Magnethermic Corporation, Warren, Ohio

[21] Appl. No.: 245,918

[22] Filed: Sep. 16, 1988

[51] Int. Cl.[4] ..... H05B 6/36

[52] U.S. Cl. ..... 219/10.69; 219/10.71; 219/10.75; 219/10.79; 266/129

[58] Field of Search ..... 219/10.69, 10.71, 10.67, 219/10.57, 10.79, 10.75, 10.43; 266/129

[56] References Cited

U.S. PATENT DOCUMENTS

| | | | |
|---|---|---|---|
| 2,308,240 | 1/1943 | Goodridge | 219/10.69 |
| 2,876,325 | 3/1959 | Baffrey | 219/10.69 |
| 3,051,812 | 8/1962 | Gschwender | 219/10.69 |
| 3,056,876 | 10/1962 | Schmidt | 219/10.69 X |
| 3,410,978 | 11/1968 | Sorensen | 219/10.69 |
| 3,424,886 | 1/1969 | Ross | 219/10.79 |
| 3,489,875 | 1/1970 | Ross | 219/10.69 |
| 3,731,040 | 5/1973 | Kasper | 219/10.79 |
| 3,905,758 | 9/1975 | Moussou et al. | 432/128 |
| 4,754,114 | 6/1988 | Sommer et al. | 219/10.79 |

FOREIGN PATENT DOCUMENTS

| | | | |
|---|---|---|---|
| 79096 | 9/1962 | France | 219/10.69 |

*Primary Examiner*—Philip H. Leung

*Attorney, Agent, or Firm*—Fay, Sharpe, Beall, Fagan, Minnich & McKee

[57] ABSTRACT

In an electric induction furnace for heating a bar-shaped workpiece, wherein the workpiece has a longitudinal axis and is conveyed through the furnace in a conveying direction orthogonal to the longitudinal axis, an induction coil comprises a continuous conductor including a plurality of substantially horizontal primary conductor members and a plurality of substantially vertical return bends. The primary conductor members and return bends are serially connected and wound about a coil axis into a spiral having a substantially rectangular shape when viewed along the coil axis, which is substantially parallel to the conveying direction. The coil encloses a heating zone and generates a varying magnetic field in the heating zone when a varying electric current is conducted in the conductor. The coil includes first and second ends and has at the second end a workpiece exit portion, which encloses an exit section of the heating zone. The return bends of the workpiece exit portion of the coil are configured to permit removal of the workpiece from the exit section of the heating zone in a removal direction coincident with the longitudinal axis of the workpiece. These return bends preferably are arcuately shaped, having a convex side facing the first end of the coil and a concave side facing the second end of the coil. The workpiece is removed from the exit section by an extendable plunger that pushes the workpiece out of the exit section in the removal direction.

14 Claims, 3 Drawing Sheets

ELECTRIC INDUCTION HEATER

BACKGROUND OF THE INVENTION

1. Field of the Invention

The present invention relates to an electric induction heater. More particularly, the invention relates to an induction heating coil for heating small-diameter, bar-shaped workpieces prior to their being forged.

2. Description of the Related Art

A basic challenge in designing a furnace to heat workpieces intended for use in a forging process is providing uniform heating of the workpiece as well as minimizing the time during which the heated workpiece is removed from the effective heating portions of the coil prior to being transported to the forging station.

Conventional electric induction furnaces used for heating small-diameter (less than one inch) bars intended for forging have various configurations. These configurations meet this challenge in different ways, none of which has proven as successful as desired.

According to one design, the workpieces are lined up end to end and are conveyed along their longitudinal axes through a circular cross-section induction coil that produces magnetic field lines substantially parallel to the workpiece axes. In addition to the general problem of cooling between heating and forging, non-uniform cooling along the length of the bar-shaped workpiece is a particular problem in this furnace configuration. The differential between the time the forward end of the workpiece exits the induction coil and the time the rearward end exits the induction coil creates a substantial temperature gradient along the length of the workpiece.

In another configuration, the workpieces are arranged with their axes parallel to each other and are conveyed through a wide oval or rectangular cross-section induction coil in a direction orthogonal to their longitudinal axes. An example of a conventional wide oval coil is described in U.S. Pat. No. 3,424,886, the disclosure of which is incorporated herein by reference to the extent necessary to achieve a thorough understanding of the background of the invention. As a practical matter, bar-shaped workpieces can be conveyed through such a coil in either of two directions, with the magnetic field lines of the coil parallel or orthogonal to the workpiece axes. In either case, coil end effects adversely effect the heating process.

In the case where the magnetic field lines are parallel to the workpiece axes, the workpiece is inserted along its longitudinal axis into one side of the opening of the coil, is rolled to the opposite side of the coil in a direction substantially parallel to the coil windings, and is then removed from the coil along its longitudinal axis. As is well known in the induction heating art, the magnetic field strength is lower at the ends of an induction coil than in the middle. Consequently, the axial ends of the workpiece, which are subject to the magnetic field of only the last one or two turns at each end of the coil, have a lower temperature than the middle portion of the workpiece. This temperature gradient is undesirable during the subsequent forging process.

Substantially uniform heating of a bar-shaped workpiece in a wide oval or rectangular cross-section coil can be achieved by conveying the workpiece through the coil with its longitudinal axis orthogonal to the magnetic field lines, that is, substantially parallel to the greater-length, horizontal segments of the coil windings. In this instance the workpiece is rolled from one open end of the coil to the other along the coil axis. Typically, however, this arrangement leaves the workpiece in the "dead" end of the coil for a period of time that is often substantially greater than the time it takes to transport the heated workpiece from the coil to the forging station, undesirably prolonging the cooling period.

The present invention is intended to provide an electric induction heater for heating bar-shaped workpieces that eliminates coil end effect problems.

The present invention also is intended to provide a wide oval or rectangular cross-section induction coil that heats bar-shaped workpieces uniformly and enables removal of the workpieces from the coil while they are still subject to a substantial magnetic field.

Additional advantages of the present invention will be set forth in part in the description that follows and in part will be obvious from that description or can be learned by practice of the invention. The advantages of the invention can be realized and obtained by the apparatus particularly pointed out in the appended claims.

SUMMARY OF THE INVENTION

The present invention overcomes the problems of prior art electrical induction heaters by providing an induction coil having return bends configured to permit a bar-shaped workpiece to be conveyed through the coil with its longitudinal axis orthogonal to the coil axis and to be removed from the coil in a direction coincident with its longitudinal axis.

To overcome the problems of the prior art, and in accordance with the purpose of the invention, as embodied and broadly described herein, the induction coil of this invention is used for heating a bar-shaped workpiece in an induction furnace wherein the workpiece has a longitudinal axis and is conveyed through the furnace in a conveying direction orthogonal to the longitudinal axis of the workpiece. The coil comprises a continuous conductor wound about a coil axis into a spiral having a plurality of turns and enclosing a heating zone. The coil axis is substantially parallel to the conveying direction. The coil includes a first end and a second end downstream of the first end in the conveying direction. The coil has a workpiece exit portion at the second end thereof, and the workpiece exit portion of the coil encloses an exit section of the heating zone. At least one of the turns in the workpiece exit portion includes a primary conductor member generating a varying magnetic field in the exit section of the heating zone when a varying electric current is conducted in the conductor to heat a workpiece in the exit section and includes a return bend configured to permit removal of the workpiece from the exit section in a removal direction coincident with the longitudinal axis of the workpiece.

In a preferred embodiment, the present invention encompasses an induction heating furnace for heating a bar-shaped workpiece having a longitudinal axis. The furnace of the invention comprises a housing having a heating zone therein, means for conveying the workpiece through the heating zone in a conveying direction orthogonal to the longitudinal axis of the workpiece, and an induction coil disposed in the housing and having a first end and a second end downstream of the first end in the conveying direction. The coil includes a plurality of substantially horizontal primary conductor members and a plurality of substantially vertical return bends serially connected and wound about a coil axis into a continuous rectangular spiral extending from the first end to the second end and enclosing the heating zone. The coil axis is substantially parallel to the conveying direction. The coil has a workpiece exit portion at the second end thereof, and the workpiece exit portion of the coil encloses an exit section of the heating zone. The return bends of the workpiece exit portion of the coil have an arcuate configuration with a convex side facing the first end of the coil and a concave side facing the second end of the coil. The arcuate return bends define first and second workpiece ports on laterally opposite sides of the exit section of the heating zone. The furnace of this invention further comprises means for connecting an alternating current power source to the coil to generate a varying magnetic field in the heating zone and means for removing the workpiece from the exit section of the heating zone through one of the workpiece ports. The removing means moves the workpiece in a removal direction coincident with the longitudinal axis of the workpiece.

The accompanying drawings, which are incorporated herein, and which constitute a part of this specification, illustrate one embodiment of the invention and, together with the description, explain the principles of the invention. The invention is not intended to be limited to this embodiment because many other alternative coil constructions are possible.

DESCRIPTION OF THE PREFERRED EMBODIMENT

Reference now will be made in detail to the presently preferred embodiment of the invention, an example of which is illustrated in the accompanying drawings.

The present invention will be described with reference to an electrical induction furnace used for heating small-diameter (less than one inch) bars having a circular cross-section. As will be apparent to one of ordinary skill in the art, however, the present invention is applicable to bar-shaped workpieces of varying sizes and configurations.

Figure 1:
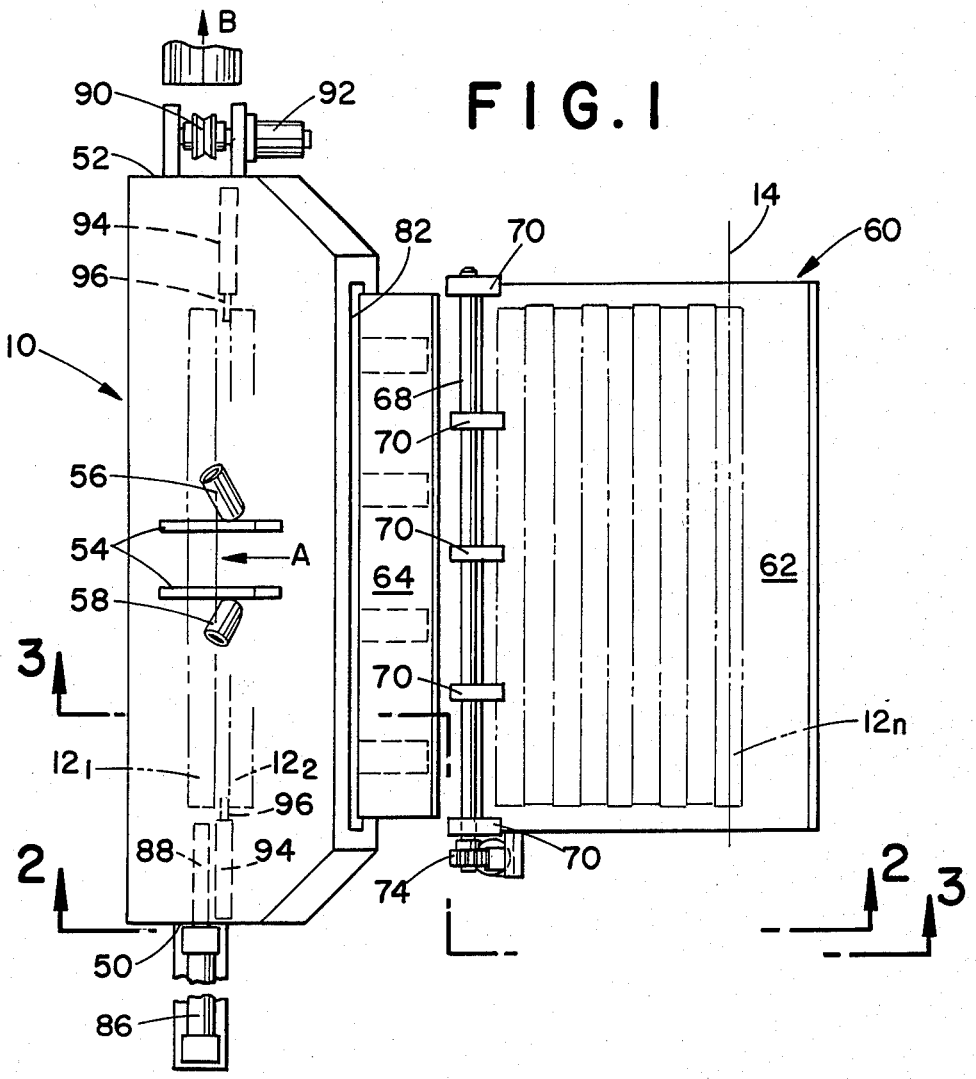
FIG. 1 is a top plan view of the electric induction furnace of the present invention.
Figure 2:
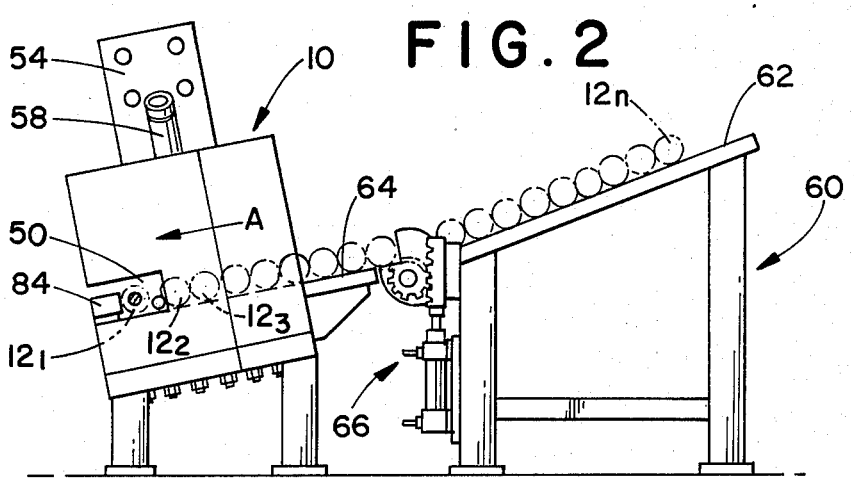
FIG. 2 is a side elevational view of the electric induction furnace of the present invention taken along line 2—2 of FIG. 1.
Figure 3:
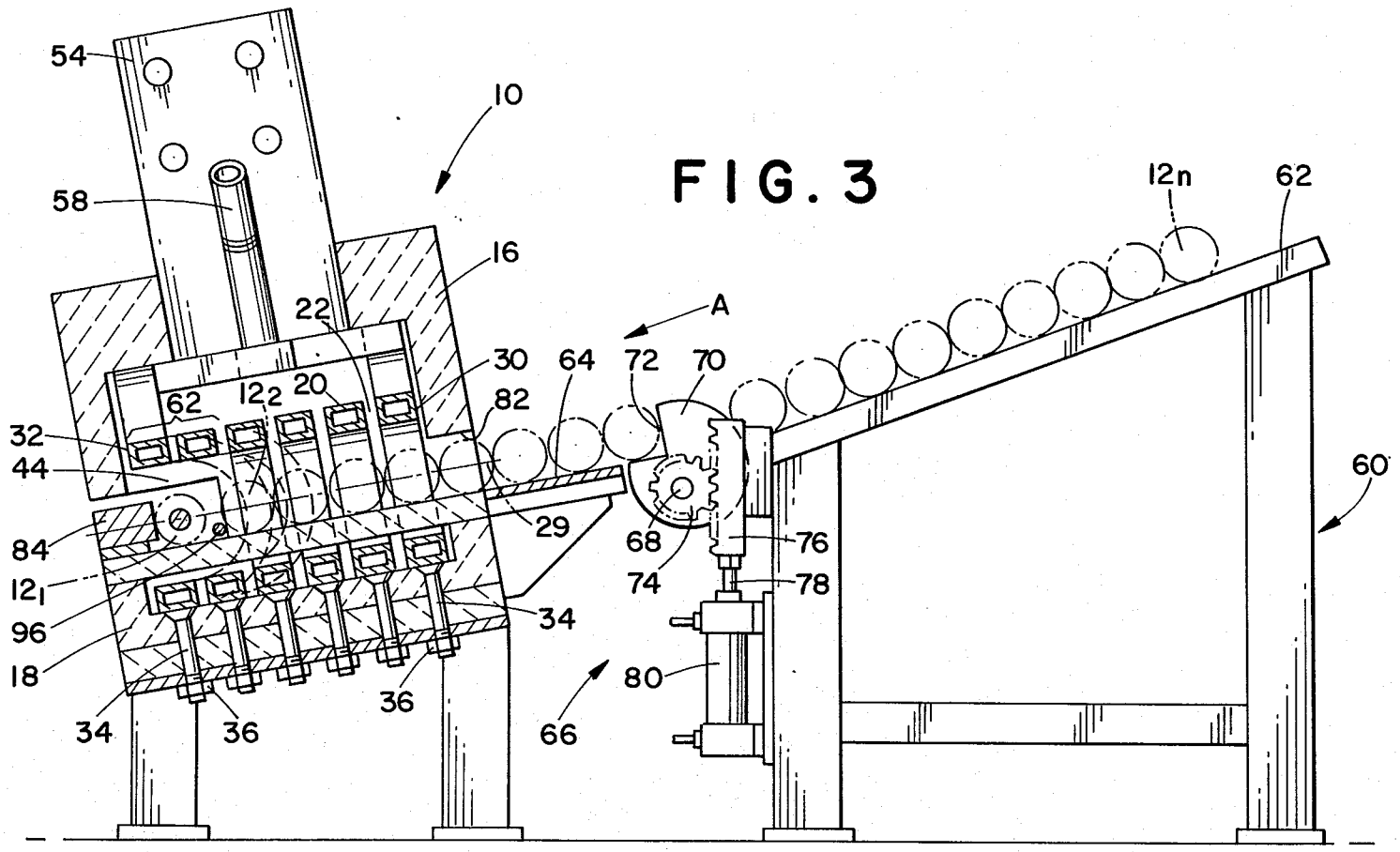
FIG. 3 is a partial cross-sectional view taken along line 3—3 of FIG. 1.

FIGS. 1-3 show electric induction furnace 10 constructed in accordance with the present invention. Furnace 10 is used to heat bar-shaped workpieces 12 (individually designated as workpieces $12_1$, $12_2$, $12_3$, . . . $12_n$), each of Which has a longitudinal axis 14.

Figure 4:
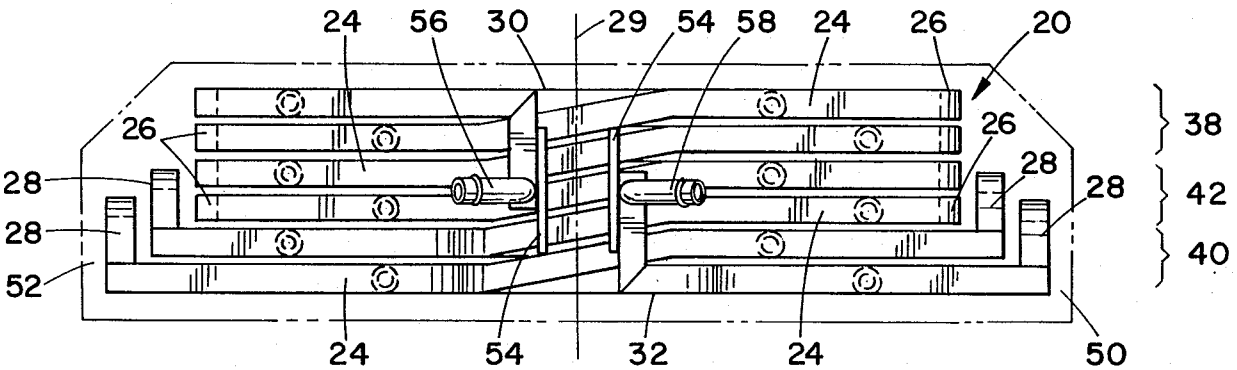
FIG. 4 is a plan view of the induction coil of the present invention.
Figure 6:
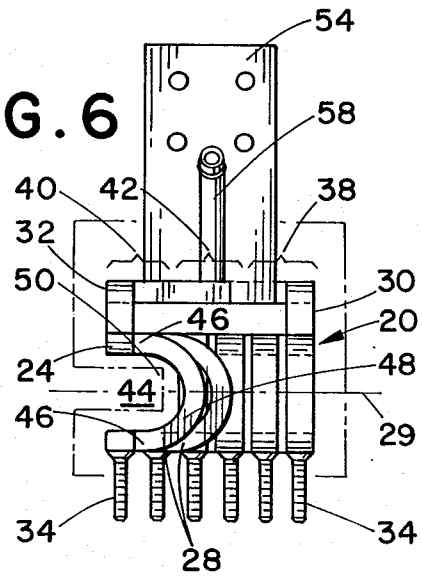
FIG. 6 is a side view of the induction coil of the present invention.
Figure 5:
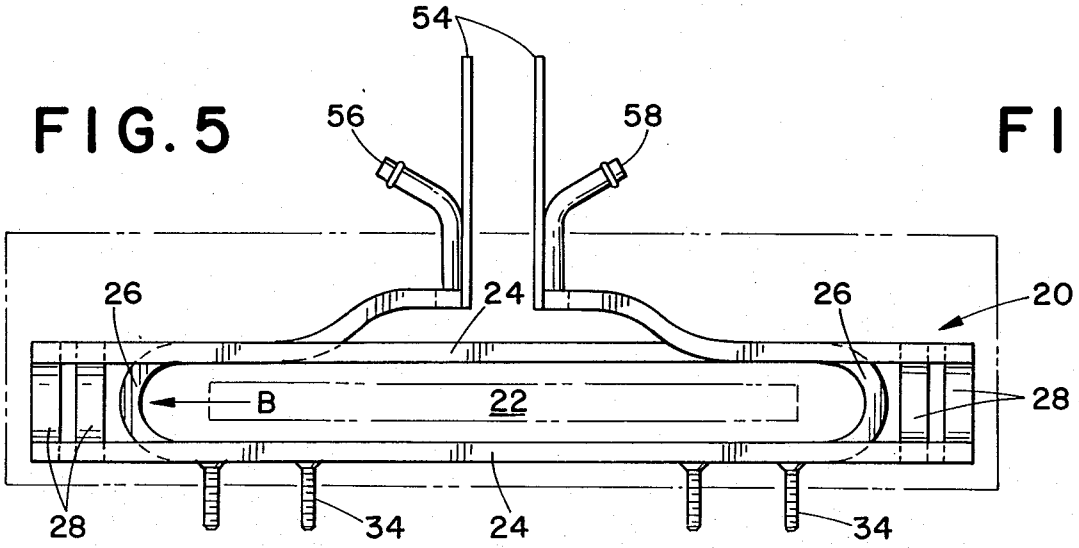
FIG. 5 is a front view of the induction coil of the present invention.

In accordance with the invention and as shown in FIG. 3, furnace 10 includes a housings 1 which preferably is formed of a refractory material. Induction coil 20 is disposed within the cavity formed in the housing 16 and encloses heating zone 22. Coil 20 comprises a continuous conductor and, as shown in FIGS. 4-6, includes a plurality of substantially horizontal primary conductor members 24 and a plurality of substantially vertical return bends 26, 28. Primary conductor members 24 and return bends 26, 28 are serially connected and wound about coil axis 29 into a continuous, generally rectangular spiral extending from a first end 30 to a second end 32. Coil 20 preferably includes a plurality of threaded studs 34 to enable it to be fixedly mounted to housing 16 with nuts 36.

The coil of this invention includes a workpiece entrance portion 38 at first end 30, a workpiece exit portion 40 at second end 32, and an intermediate portion 42 between entrance portion 38 and exit portion 40. Workpieces 12 are arranged within heating zone 22 with their longitudinal axes 14 parallel and horizontal and are conveyed through heating zone 22 in a conveying direction A that is orthogonal to longitudinal axes 14. Conveying direction A is substantially parallel to coil axis 29 and to the magnetic field lines produced within heating zone 22 by coil 20. Workpieces 12 are conveyed first through workpiece entrance portion 38, then through intermediate portion 42, and finally into workpiece exit portion 40 of coil 20. Workpiece exit portion 40 encloses an exit section 44 of heating zone 22. The workpiece located in exit section 44 is designated by reference numeral $12_1$.

As is well known in the art, the workpieces in heating zone 22 are heated by electric induction, that is, by a varying magnetic field produced by conducting a varying electric current through the conductor of coil 20. The varying current preferably is AC current having a frequency of about 10 KHz although it will be appreciated by those skilled in the art that a wide range of operating frequencies could be used even as low as 500 or 1000 hertz. In a wide oval or rectangular cross-section induction coil such as coil 20, the magnetic field effectively is due to the current in the greater-length portions of the coil, that is, primary conductor members 24. Return bends 26, 28 basically serve to maintain electrical continuity between primary conductor members 24 and make a negligible contribution to the magnetic field that heats workpieces 12.

Return bends 26 of workpiece entrance portion 38 and intermediate portion 42 preferably are arcuate in shape with their concave sides facing inwardly. The configuration of return bends 26 is typical of conventional wide oval or rectangular cross-section induction coils.

In accordance with the invention, the return bends of workpiece exit portion 40 of coil 20 are configured to permit removal of workpiece $12_1$ from exit section 44 of the heating zone in a direction coincident with longitudinal axis 14 of workpiece $12_1$. With reference to FIG. 6, each return bend 28 of workpiece exit portion 40 includes a pair of end sections 46, each connected to a primary conductor member 24, and an intermediate section 48 extending from end sections 46 toward first end 30 of coil 20. As shown in FIG. 6, return bends 28 preferably have an arcuate configuration with a convex side facing first end 30 and a concave side facing second end 32 of coil 20. Return bends 28 define first and second workpiece ports 50 and 52 on laterally opposite sides of exit section 44 and enable removal of a workpiece $12_1$ from exit section 44 in a removal direction B coincident with longitudinal axis 14.

In the preferred embodiment of the invention shown in the drawings, workpiece exit portion 40 includes approximately two full turns of the conductor comprising coil 20, and the two return bends 28 on each lateral side of exit section 44 extend toward first end 30 of coil 20 to such an extent that workpiece ports 50, 52 are partially blocked by portions of return bends 26 of the adjacent turn (See FIG. 6). While the precise configuration of return bends 28 may vary with each particular application, they should extend toward first end 30 of coil 20 to a degree that enables workpiece $12_1$ to be removed from exit section 44 in removal direction B while it is subject to the magnetic field created by at least two turns of the conductor of coil 20.

The electric induction furnace of this invention includes means for connecting a variable-current power source to coil 20 to generate a varying magnetic field in heating zone 22. As embodied herein, the connecting means includes power leads 54, which are connected to the ends of the conductor forming coil 20 and preferably extend out of upper housing 16 of furnace 10.

The conductor forming coil 20 preferably is hollow to permit introduction of a cooling fluid such as water to prevent heat damage to coil 20. Accordingly, the coil of this invention includes means for connecting a cooling fluid supply to the conductor members of coil 20. As embodied herein, the cooling fluid connecting means includes fluid inlet 56 and fluid outlet 58, which are respectively connected to the ends of the conductor forming coil 20 and communicate with the interior of the hollow conductor.

In accordance with the invention, the furnace is provided with means for conveying the workpiece through heating zone 22 in a conveying direction orthogonal to longitudinal axis 14 of the workpiece. As embodied herein and as shown in FIGS. 1–3, the conveying means of this invention includes supply table 60, which has inclined supply ramp 62. Supply ramp 62 supports a plurality of workpieces 12 arranged with their longitudinal axes 14 parallel to each other and orthogonal to conveying direction A. The supply means to this invention also includes inclined guide surface 64, which extends through the interior of coil 20 and guides workpieces 12 as they are conveying through heating zone 22. Guide surface 64 preferably positions workpieces 12 equidistant between upper and lower primary conductor members 24 (along coil axis 29), where the magnetic field strength of coil 20 is greatest. Guide surface 64 preferably is formed of a refractory material.

In the embodiment of the invention shown in FIGS. 1–3, the conveying means of this invention also includes transfer mechanism 66, which transfers individual workpieces 12 from supply ramp 62 to guide surface 64. Transfer mechanism 66 includes transfer shaft 68, which is rotatably mounted on supply table 60 between supply ramp 62 and guide surface 64. A plurality of transfer cams 70 are mounted on and rotate with transfer shaft 68. Each transfer cam 70 includes a holding notch 72. Pinion gear 74 is mounted on one axial end of transfer shaft 68 and meshes with rack member 76. Rack member 76 is mounted on movable plunger 78 of actuating cylinder 80. Cylinder 80 preferably is hydraulically actuated.

With reference to FIG. 3, retraction of plunger 78 causes rack member 76 to move downwardly and rotate pinion gear 74, transfer shaft 68, and transfer cams 70 in a clockwise direction. When holding notches 72 align with the lower end of supply ramp 62, the lowermost workpiece on supply ramp 62 moves into notches 72 under the influence of gravity. Plunger 78 then is extended, and rack member 76 causes counter-clockwise rotation of pinion gear 74, transfer shaft 68, and transfer cams 70 until holding notches 72 align with the upper end of guide surface 64. At this point, the transferred workpiece moves under the influence of gravity onto guide surface 64.

Workpieces 12 pass through workpiece opening 82 in furnace 10 and enter heating zone 22 at first end 30 of coil 20. At the lowermost end of guide surface 64, furnace 10 includes stop member 84, which holds lowermost workpiece $12_1$ in a preselected stop position within exit section 44 of heating zone 22 and prevents workpiece $12_1$ from leaving exit section 44 in conveying direction A. The precise location of workpiece $12_1$ within exit section 44 thus is determined by the positioning of stop member 84. Preferably, stop member 84 positions workpiece $12_1$ no closer to second end 32 of coil 20 than is shown in FIG. 3, that is, approximately equidistantly between the two lowermost turns of coil 20.

The electric induction furnace of this invention includes means for removing the workpiece from the exit section of the heating zone through one of the workpiece ports in the removal direction. As embodied herein, the removing means includes hydraulic cylinder 86 mounted on furnace 10 and including plunger 88, which is extendable in removal direction B through first workpiece port 50. Plunger 88 pushes the workpiece $12_1$ out of exit section 44 along its longitudinal axis 14 through laterally opposite second workpiece port 52, where it is conveyed in removal direction B to a forging station (not shown) by rotating workpiece sheave 90. Sheave 90 is rotated by motor 92.

To ensure that only one workpiece at a time is removed from exit section 44, the induction furnace of this invention is provided with a pair of holding cylinders 94 at laterally opposite ends of exit section 44. Each holding cylinder 94 includes an extendable holding bar 96 that prevents workpiece $12_2$ from contacting workpiece $12_1$ in the exit section of the heating zone. Once workpiece $12_1$ has been removed from exit section 44, holding bars 96 retract momentarily into holding cylinders 94 to permit workpiece $12_2$ to roll, under the influence of gravity, into exit section 44. Holding bars 96 then are extended to prevent workpiece $12_3$ from entering exit section 44.

It will be apparent to those skilled in the art that modifications and variations can be made in the apparatus of the invention without departing from the scope of the invention. For example, the return bends in the workpiece exit portion of the coil can have other shapes, such as a V-shaped or a squared-off U-shape, defining a workpiece port that enables removal of the workpiece from the exit section from the heating zone along its longitudinal axis. The invention in its broader aspects is, therefore, not limited to the specific details and illustrated examples shown and described. Accordingly, it is intended that the present invention cover such modifications and variations provided that they fall within the scope of the appended claims and their equivalents.

What is claimed is:

1. An induction coil for heating a bar-shaped workpiece in an induction furnace, wherein the workpiece has a longitudinal axis and is conveyed through the furnace in a conveying direction orthogonal to the longitudinal axis of the workpiece, the coil comprising a continuous conductor wound about a coil axis into a spiral having a plurality of turns and enclosing a heating zone, said coil axis being substantially parallel to the conveying direction, said coil including a first end and a second end downstream of said first end in the conveying direction, said coil having a workpiece exit portion having a plurality of coil turns at said second end thereof, said workpiece exit portion of said coil enclosing an exit section of said heating zone, at least one of said turns in said workpiece exit portion including a primary conductor member generating a varying magnetic field in said exit section of said heating zone when a varying electric current is conducted in said conductor to heat a workpiece in said exit section and including a return bend configured to permit removal of the workpiece from said exit section in a removal direction coincident with the longitudinal axis of the workpiece.

2. An induction coil for heating a bar-shaped workpiece in an induction furnace, wherein the workpiece has a longitudinal axis and is conveyed through the furnace in a conveying direction orthogonal to the longitudinal axis of the workpiece, the coil comprising:

a continuous conductor including a plurality of substantially horizontal primary conductor members and a plurality of substantially vertical return bends serially connected and wound about a coil axis into a spiral having a substantially rectangular shape when viewed along said coil axis, said coil axis being substantially parallel to the conveying direction, said coil enclosing a heating zone and generating a varying magnetic field in said heating zone when a varying electric current is conducted in said conductor, said coil including a first end and a second end downstream of said first end in the conveying direction, said coil having a workpiece exit portion at said second end thereof, said workpiece exit portion of said coil including said plurality of substantially vertical return bends and enclosing an exit section of said heating zone, and said return bends of said workpiece exit portion of said coil being configured to permit removal of the workpiece from said exit section of said heating zone in a removal direction coincident with the longitudinal axis of the workpiece.

3. The heater of claim 2, wherein each of said return bends of said workpiece exit portion of said coil have first and second end sections, each respectively connected to a primary conductor member, and an intermediate section extending from said first and second end sections toward said first end of said coil.

4. The heater of claim 3, wherein each of said return bends of said workpiece exit portion of said coil is arcuately shaped.

5. An induction heating furnace for heating a bar-shaped workpiece having a longitudinal axis, the furnace comprising:

a housing having a heating zone therein;

means for conveying the workpiece through said heating zone in a conveying direction orthogonal to the longitudinal axis of the workpiece;

an induction coil disposed in said housing and having a first end and a second end downstream of said first end in said conveying direction, said coil including a plurality of substantially horizontal primary conductor members and a plurality of substantially vertical return bends serially connected and wound about a coil axis into a continuous rectangular spiral extending from said first end to said second end and enclosing said heating zone, said coil axis being substantially parallel to the conveying direction, said coil having a workpiece exit portion at said second end thereof, said workpiece exit portion of said coil including said plurality of substantially vertical return bends and enclosing an exit section of said heating zone, said return bends of said workpiece exit portion of said coil having an arcuate configuration with a convex side facing said first end of said coil and a concave side facing said second end of said coil, said arcuate return bends defining first and second workpiece ports on laterally opposite sides of said exit section of said heating zone;

means for connecting a variable-current power source to said coil to generate a varying magnetic field in said heating zone; and means for removing the workpiece from said exit section of said heating zone through one of said workpiece ports, said removing means moving the workpiece in a removal direction coincident with the longitudinal axis of the workpiece.

6. The furnace of claim 5, Wherein said conductor members are tubular and said coil includes means for connecting a cooling fluid supply to said conductor members.

7. The furnace of claim 5, wherein said power source connecting means includes a pair of power leads connected to said coil.

8. The furnace of claim 5, wherein said removing means includes a plunger mounted on said frame and extendable through said first workpiece port in the removal direction to push the workpiece out of said exit section of said heating zone through said second workpiece port.

9. The furnace of claim 5, further comprising an inclined guide surface extending through said coil, said guide surface supporting the workpieces within said heating zone.

10. The furnace of claim 9, wherein said guide surface supports the workpieces substantially in the center of said heating zone.

11. The furnace of claim 9, wherein said guide surface is formed of a refractory material.

12. The furnace of claim 9, further comprising a stop member fixed to said guide surface at said second end of said coil, said stop member holding a workpiece in said exit section of said heating zone in a preselected stop position.

13. The furnace of claim 9, further comprising holding means for selectively holding a workpiece on said guide surface upstream of said exit section of said heating zone in said conveying direction.

14. The furnace of claim 13, wherein said holding means includes at least one holding cylinder mounted in said furnace upstream of said exit section of said heating zone, said holding cylinder having a holding bar selectively extendable from said holding cylinder to prevent a workpiece from moving down said inclined guide surface into said exit section.

* * * * *